US005329478A

United States Patent [19]

Kirk et al.

[11] Patent Number: 5,329,478

[45] Date of Patent: Jul. 12, 1994

[54] CIRCUIT AND METHOD FOR ESTIMATING GRADIENTS

[76] Inventors: David B. Kirk, 361 Monterey, South Pasadena, Calif. 91030; Douglas A. Kerns, 610 E. California Blvd., #7; Brooke P. Anderson, 1155 E. Del Mar #312, both of Pasadena, Calif. 91106; Kurt Fleischer, 2262 E. Oakdale St., Pasadena, Calif. 91107; Alan H. Barr, 1111 Blanche St., Apt. 102, Pasadena, Calif. 91106

[21] Appl. No.: 981,762

[22] Filed: Nov. 25, 1992

[51] Int. Cl.[5] ..... G06G 7/18

[52] U.S. Cl. ..... 364/828

[58] Field of Search ..... 364/828, 819, 820, 825, 364/728.03

[56] References Cited

U.S. PATENT DOCUMENTS 5,099,156 3/1992 Delbrück et al. ..... 307/529
5,168,459 12/1992 Hiller ..... 364/728.03

OTHER PUBLICATIONS

Alspector, J., J. W. Gannett, S. Haber, M. B. Parker, and R. Chu, "A VLSI-Efficient Technique for Generating Multiple Uncorrelated Noise Sources and Its Application to Stochastic Neural Networks," IEEE Transactions on Circuits and System, vol. 38, No. 1, pp. 109-123, Jan. 1991.

Alspector, J., B. Gupta, and R. B. Allen, "Performance of a Stochastic Learning Microchip," in *Advances in Neural Information Processing Systems,* vol. 1, Denver, Colo., Nov. 1988. D. S. Touretzky, ed., Morgan Kauffman Publishers, 1989, pp. 748-760.

Delbrück, Tobi, "'Bump' Circuits for Computing Similarity and Dissimilarity of Analog Voltages," Caltech Computation and Neural Systems Memo No. 10, May 23, 1991.

Dembo, A., and T. Kailath, "Model-Free Distributed Learning," IEEE Transactions on Neural Networks, vol. 1, No. 1, pp. 58-70, Mar. 1990.

Kirk, et al., "Constrained Optimization Applied to the Parameter Setting Problem for Analog Circuits," IEEE Neural Information Processing Systems 1991 (NIPS91), Morgan Kaufman, San Diego, 1991.

Platt, John, "Constrained Optimization for Neural Networks and Computer Graphics," Ph.D. Thesis, California Institute of Technology, Caltech-CS-TR-89-07, Jun. 1989.

Umminger, Christopher B., and Steven P. DeWeerth, "Implementing Gradient Following in Analog VLSI," Advanced Research in VLSI, MIT Press, Boston, Mar. 1989, pp. 195-208.

*Primary Examiner*—Long T. Nguyen

[57] ABSTRACT

A circuit and method for estimating gradients of a target function using noise injection and correlation is provided. In one embodiment, an input signal is combined with an input noise signal and the combined signal is input to a circuit which computes the output of the target function. An amplified noise signal and output signal of the target function are input to a multiplier which performs a correlation of the inputs. The output of the multiplier is processed by a low-pass filter which generates the gradient. The circuit and method can be expanded to N-dimensions. Furthermore, in a alternate embodiment, a differentiator is coupled between the multiplier and amplifier and the multiplier and the output of the target function to differentiate the two signals prior to input to the multiplier. In other embodiments, the circuit may be used to compute gradient-like signals, wherein each component of the gradient is individually scaled by a different value. The output of the circuit can then be used in other descent algorithms. In addition, varying the scale of the noise signal over a time schedule, an annealing style of optimization can be implemented. This prevents the gradient process from stopping at local minima while descending to the global minimum of the function.

29 Claims, 11 Drawing Sheets

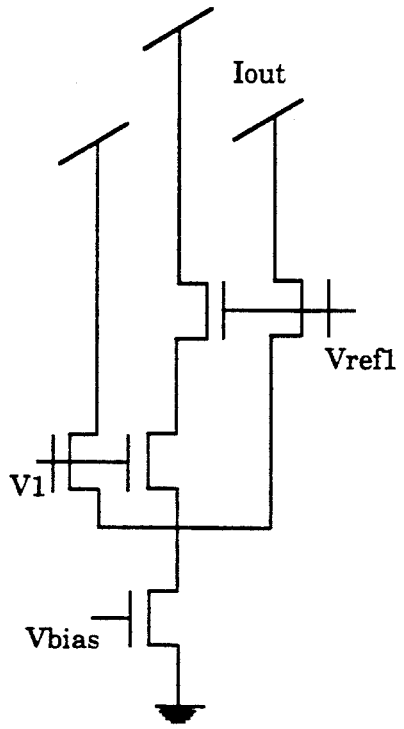
*Figure 2a1*
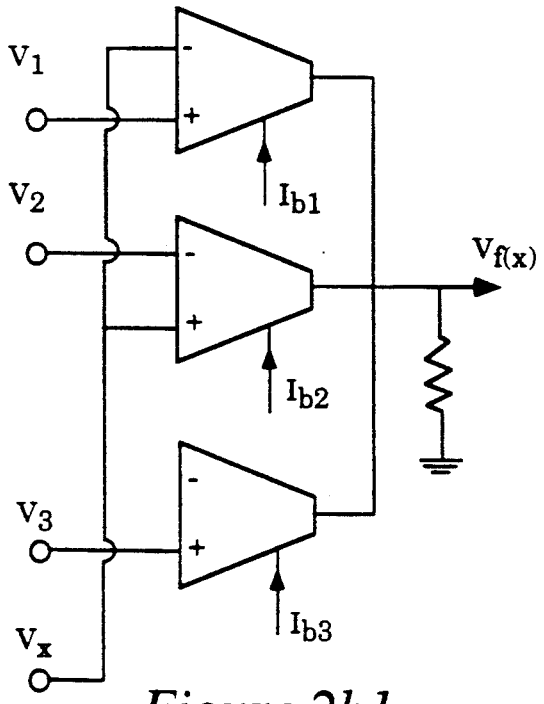
*Figure 2b1*
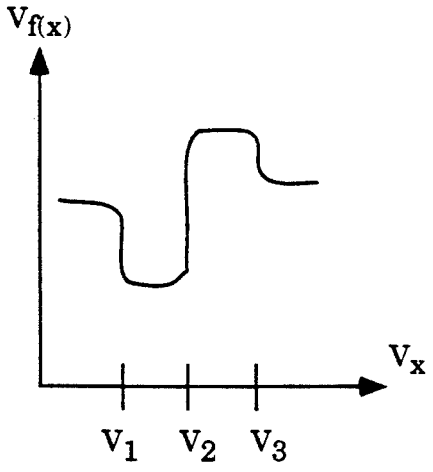
*Figure 2b2*

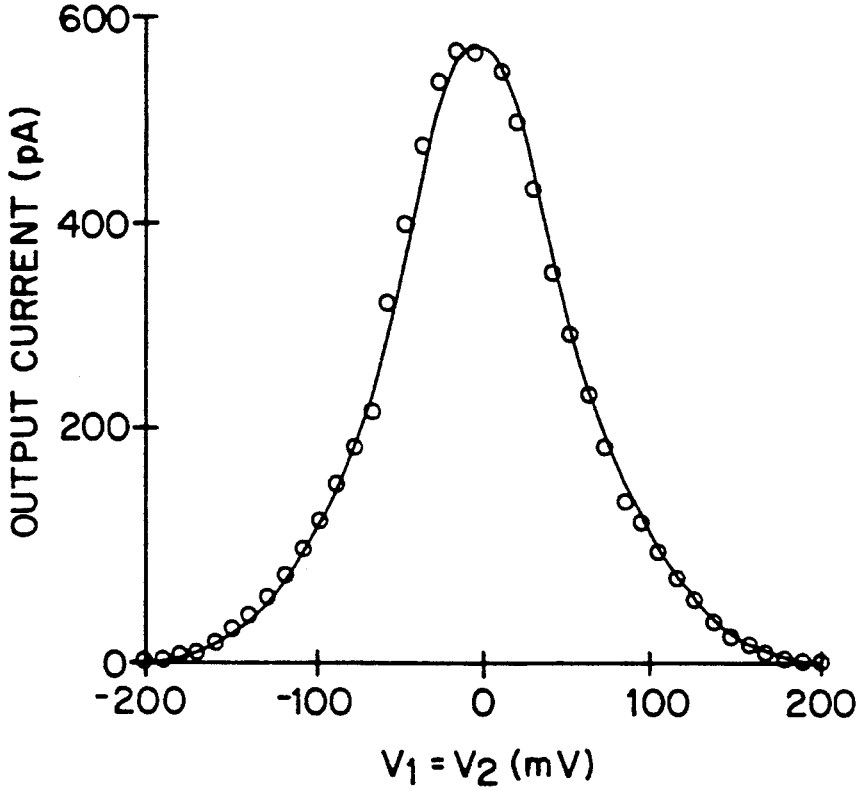
*Figure 2a2*

CIRCUIT AND METHOD FOR ESTIMATING GRADIENTS

BACKGROUND OF THE INVENTION

1. Field of the Invention

The present invention relates to the estimation of gradients. More particularly, the present invention relates to the use of noise injection and correlation in analog circuits to estimate gradients.

2. Art Background

Computation of gradient descent and related descent and annealing techniques is frequently performed in digital systems and used in a variety of applications. In some applications, such as neural networks, it is desirable to utilize a gradient descent method of optimization to minimize an objective function.

One common approach to optimization is gradient descent wherein, for example, in one dimension:

$$\frac{dx}{dt} = -\alpha \frac{df}{dx}$$

where $\alpha > 0$ and is a constant. Because the value of f decreases until x stops changing:

$$\frac{df}{dt} = \frac{df}{dx} \frac{dx}{dt} = -\frac{1}{\alpha}\left(\frac{dx}{dt}\right)^2 => \begin{cases} =0 & \text{if } \frac{dx}{dt} = 0 \rightarrow \frac{df}{dx} = 0 \\ <0 & \text{otherwise} \end{cases}$$

At the point df/dx=0, the point is at a minimum.

For example, the one dimensional gradient descent method of optimization may be used as part of an adaptive control system where a function f(x) is bounded below and f and x are both scalars, and it may be necessary to minimize the function where $f$ represents an error between actual and desired outputs. Alternately, it may be necessary to minimize a function as part of a learning system (such as a neural network).

One application of this capability to estimate gradients and perform descent is to automatically set circuit parameters. Automated on-chip parameter setting has become an important component of analog VLSI implementations of learning. Off-chip optimization techniques, such as using a digital computer, become impractical in implementation as the number of parameters increases. This is due to the fact that when extended to multiple dimensions, searches in large dimensional spaces are difficult and slow to perform in digital computer implementations. However, while the gradient descent algorithm is straightforward to implement on a digital computer, exact computation of the objective function's gradient is very difficult to implement in analog circuits, including analog VLSI.

SUMMARY OF THE INVENTION

It is therefore an object of the present invention to provide an analog circuit which estimates gradients of objective functions such as error metrics or energy functions.

It is an object of the present invention to provide an analog VLSI implementation of a multidimensional gradient descent circuit for minimizing an on chip function f().

It is further an object of the present invention to use noise injection and multiplicative correlation to estimate gradients in multiple dimensions.

A method and apparatus for estimating gradients of a target function using noise injection and correlation is discussed. In one embodiment an input signal is summed with a noise signal. The summed signal is the input to a circuit which computes the function for which the gradient is to be determined. Optionally, the noise signal is also input to an amplifier which adjusts the noise signal according to a gain parameter. The adjusted noise signal and the output signal of the function are input to a correlator, such as a multiplier. The output of the correlator is processed by a filter which generates the gradient output. In an alternate embodiment the signals are differentiated prior to being correlated by a first differentiator coupled between the function output and the correlator and a second differentiator coupled between the output of the amplifier and the correlator.

In another embodiment, the determination of the gradient is expanded to multiple dimensions. The circuit comprises a multiplicity of noise signals and a multiplicity of input signals corresponding to different components. These corresponding noise signal and input signals are then summed and input to a target function of N input variables which is to be minimized. The output of the multidimensional function comprising a single value, is input to a plurality of N sub-circuits, each sub-circuit receiving as input one noise input and the output signal of the target function. In each sub-circuit, the function output signal and noise signal are individually differentiated and subsequently correlated together using a multiplier. The results in each component are then low-pass filtered providing N derivative estimates which together form the gradient for the multidimensional function.

BRIEF DESCRIPTION OF THE DRAWINGS

The objects, features and advantages of the present invention will be apparent to one skilled in the art from the following detailed description in which:

FIG. 2a1 is an illustration of a bump circuit and FIG. 2a2 is a signal plot of the "bump" circuit.

FIG. 2b1 is a block diagram illustration of an exemplary target function f(x) and FIG. 2b2 is a signal plot representative of the function.

DETAILED DESCRIPTION OF THE INVENTION

In the following description, for purposes of explanation, numerous details are set forth, such as the functions to be minimized and specific components of the circuit, in order to provide a thorough understanding of the present invention. However, it will be apparent to one skilled in the art that these specific details are not required in order to practice the invention. In other instances, well known electrical structures and circuits are shown in block diagram form in order not to obscure the present invention unnecessarily.

The circuit and method of the present invention estimate gradients of a function f() using noise injection and correlation. Furthermore, the circuit and method described herein can be used to minimize a function using a gradient descent method of optimization. The methods and circuits described herein can also be used to perform other descent, annealing or optimization techniques using scaled versions of the individual components of the estimated circuit. Thus with only small added circuit complexity, the performance of analog VLSI circuits are enhanced by enabling the circuits to be intrinsically adaptive by providing on-chip optimization capability. Furthermore, the circuit can also be used for learning in neural networks.

Figure 1:
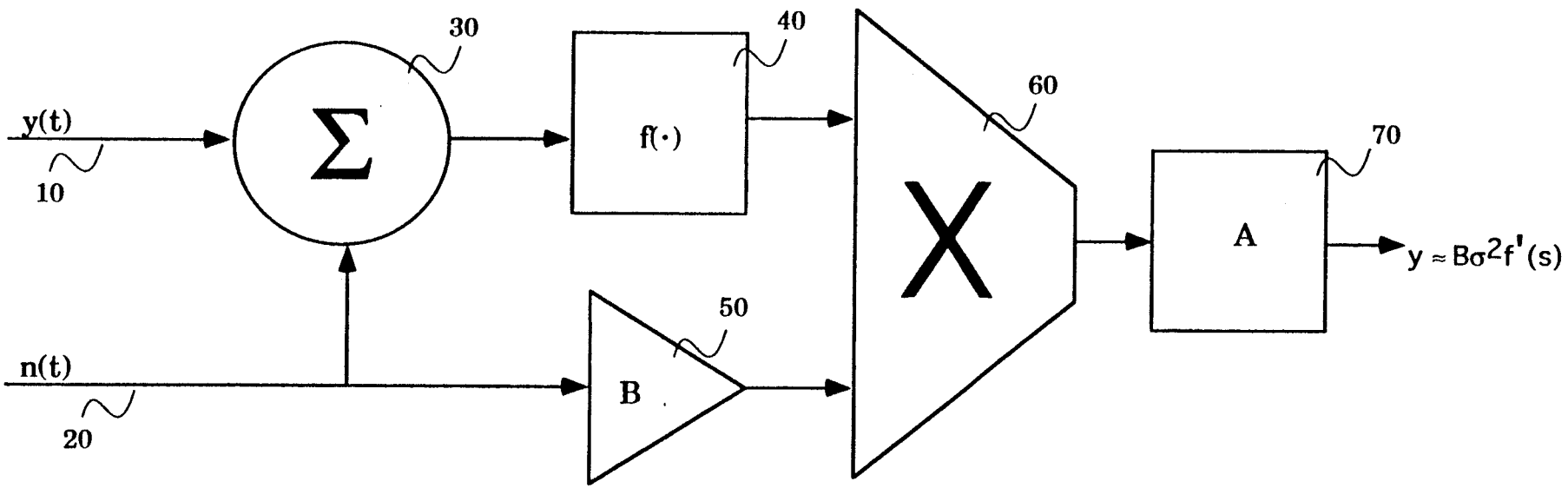
FIG. 1 is a block diagram of a gradient estimation technique of the present invention in one dimension.

A block diagram representation of a gradient estimation circuit is shown in FIG. 1. The circuit includes a signal input S(t) 10 and noise input n(t) 20. The noise input 20 may be any signal noise; for example, in the present illustration, the noise input 20 is generated by amplifying the intrinsic noise in MOS devices. Similarly, the signal input will vary. For example, for test purposes, it may be desirable to input a simple waveform such as a slow triangular waveform.

The noise input 20 and signal input 10 are combined by the representative summing component 30. The noise input 20 can optionally be input to a gain component 50, such as an amplifier, set according to an adjustable gain parameter $\beta$ to adjust the gain of the noise input 20. The output of the summing component 30 is provided as input to a circuit 40 which executes the function f(). The function f() can be any scalar function, including an error metric. For example, the function can be a basis function such as the "bump" circuit of Delbrück, et al., U.S. Pat. No. 5,099,156. An embodiment of the bump circuit is illustrated in FIG. 2*a*1. The example discussed below utilizes a function illustrated in FIG. 2*b*2, constructed of several transconductance amplifiers. The output of the function 40 and the output of the gain component 50 are input to a multiplier 60, and the output is input to low-pass filter 70 to output an estimation of the gradient.

Figure 3:
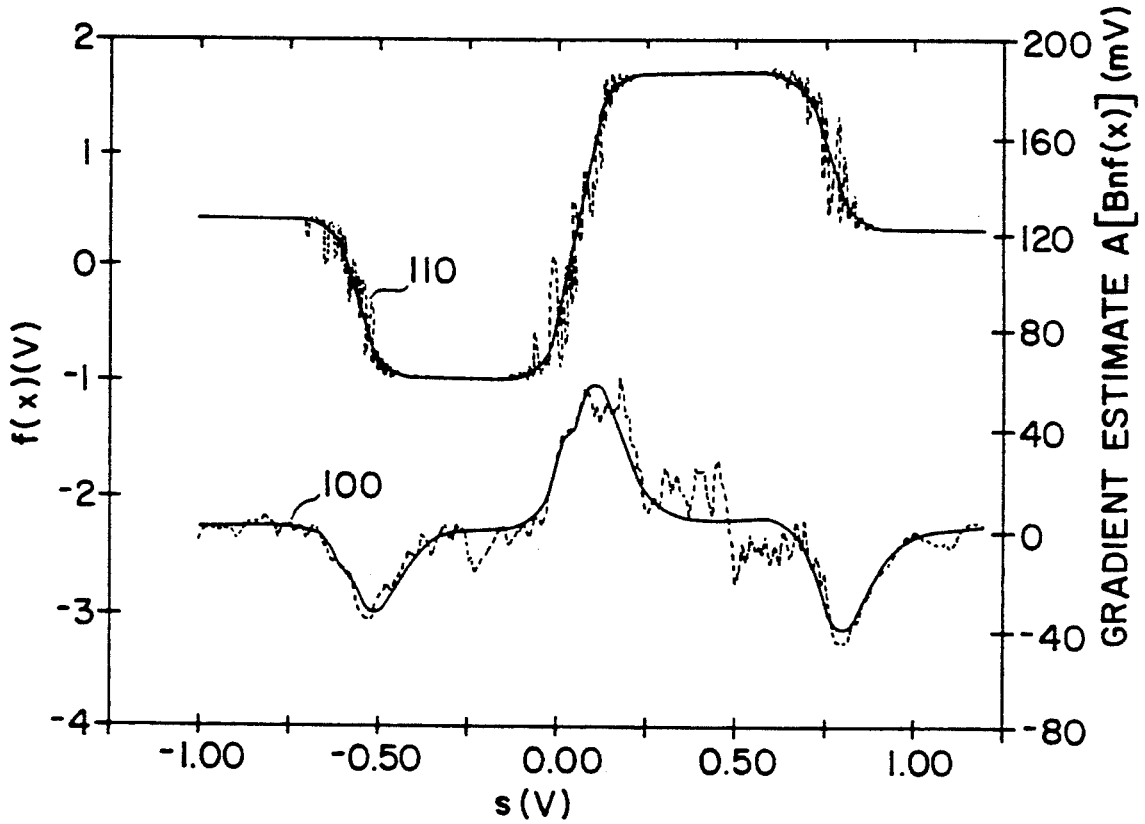
FIG. 3 is a signal plot of the output of the gradient estimation circuit of FIG. 1 using the input signal of FIG. 2b.

FIG. 3 is representative of the test results for a triangular waveform signal input and the function shown in FIG. 2*b*2. The output of the system was examined as a function of the signal input rather than a function of time as this allowed better visualization of the gradients. The upper two curves are representative of the function output, single sweep and averaged multiple sweeps. The lower two curves represent the gradient estimate. The parameters of the circuit can be varied to achieve optimum results.

The theory of operation can be explained as follows. It is assumed that the gradient of f(x), where x is a scalar, is to be determined. Let x=s+n, where s(t) is the point at which the gradient is to be evaluated (this point may vary in time) and where n(t) is noise (a stochastic scalar evolving in time). If $|n| << 1$, and assuming f and its derivatives exist, f can be expanded in a Taylor series:

$$f(x)=f(s)+f'(s)n+\tfrac{1}{2}f''(s)n^2+O(n^3).$$

E[nf(x)] is then computed, where E is the expectation operator for the noise, defined formally as $E[\cdot]\triangleq\int(\cdot)P(n)dn$ where P(n) is the probability distribution for n and where P(n) is stationary, i.e., time independent. It is further assumed that s and n are independent, $E[n]=E[n^3]=0$, since P(n) has a stationary probability distribution, and $E[n^2]=\sigma^2$=a constant. Therefore, $$nf(x)=nf(s)+n^2f'(s)+\tfrac{1}{2}n^3f''(s)+O(n^4) \quad (1)$$

and $$E[nf(x)]=\sigma^2f'(s)+O(E[n^4]). \quad (2)$$

Thus, E[nf(x)] is approximately proportional to the gradient as long as |n| is small.

However, while most of (2) can be computed in analog hardware (a noise generator can generate n, an adder can compute x=s+n, and a multiplier can compute nf(x)), there is no exact way to generate an expectation operator E. That would require either an ensemble average or, if the noise is ergodic, a time average with an infinite time interval. It is possible to approximate E by a linear, time-invariant low-pass filter; and low-pass filters are easy to build in analog hardware. The low-pass operator is denoted by A.

Referring to (2), the object now is to approximate $\sigma^2f'(s)$ by A[nf(x)]. Defining, $y_0\triangleq\sigma^2f'(s)$ and $y\triangleq A[nf(x)]$, if $|y-y_0|<<|y_0|$, the approximation is sufficient. A quantitative measure of this is the signal-to-noise ratio: $SNR=y_0^2/E[(y-y_0)^2]$. The denominator is the mean-square error, MSE. This can be expanded as $$MSE=E[(y-y_0)^2]=V[y]+(y_0-E[y])^2$$

where $V[y]=E[y^2]-(E[y])^2$ is the variance of y. The MSE is computed as follows.

First, find E[y]. Since A is linear, $$E[y]=E[A[nf(x)]]=A[E[nf(x)]]=\sigma^2A[f'(s)]+O(E[n^4]).$$

Assuming that the signal s is bandlimited, $|A[f'(s)]-f'(s)|$ is small; i.e., $A[f'(s)]=f'(s)+\Delta_s$ where $|\Delta_s|<<1$. Therefore, $$E[4]=y_0+O(E[n^4])+\sigma^2\Delta_s$$

Next, find V[y]. In (1), nf(x) is expanded into terms which factor into a noise component and a signal component. Thus, considering the case of filtering a signal contaminated by multiplicative noise: A[mr] where m(t) is noise with a stationary probability distribution, r(t) is an independent signal, and A is a linear, time-invariant low-pass filter:

$$V[A[mr]] \leqq \frac{2}{\pi} A_m^2 W_a V[m] T_{ac} P_3 \quad (3)$$

where $A_m$ is the maximum amplitude of the filter's transfer function, $W_a$ is the bandwidth of the filter, $T_{ac}$ is the autocovariance time for the noise, and $P_s$ is a particular measure of the power in r(t). Assuming $A_m \approx 1$, which is true for most simple low-pass filters, $V[A[mr]] = O(W_a V[m] T_{ac} P_s)$. From (1), it is clear that the term which will contribute the most variance (lowest order in n) is the first. Setting m(t)=n(t) and r(t)=f(s(t)), $V[A[nf(s)]] = O(W_a \sigma^2 T_{ac} P_s)$ where $T_{ac}$ is the autocovariance time for n and $P_s$ is a measure of the power in f(s). Thus, at the lowest order in n, $$V[y] = O(V[A[nf(s)]]) = O(W_a \sigma^2 T_{ac} P_s).$$

Putting all of this together, $$SNR = \frac{\sigma^4 [f'(s)]^2}{O(W_a \sigma^2 T_{ac} P_s) + [O(E[n^4]) + \sigma^2 \Delta_s]^2} \quad (4)$$

Let x be referred to as the "order parameter" and y be an adjustable parameter which can be made arbitrarily small. If z=O(yxP) and p>0, this is denoted by z<O(y). Conversely, if p<0, this is denoted by z>O(y). It will be useful to express final results in terms of only one adjustable parameter. For example, for z=O(xy), since y is arbitrarily adjustable, let y be a convenient function of x, say $y = x^q$ where q is a constant. In that case, $z = O(x^{(1+q)})$. Using $\sigma$ as the order parameter in (4), the SNR should be >O(1) so that it can be increased to acceptable levels by decreasing the amplitude of the noise. To achieve this, the denominator in (4) should be $<O(\sigma^4)$ because the numerator is $O(\sigma^4)$. Adjusting $\Delta_s$ so that it is <O(1), the second term in the denominator is $<O(\sigma^4)$. As $P_s \geqq \max_t[f(s(t))]^2$, $P_s$ is not in general small. Thus, $W_a T_{ac} < O(\sigma^2)$. If all of these conditions are satisfied and if the noise amplitude is made small enough, $A[nf(x)] \approx \sigma^2 f'(s)$.

Figure 4:
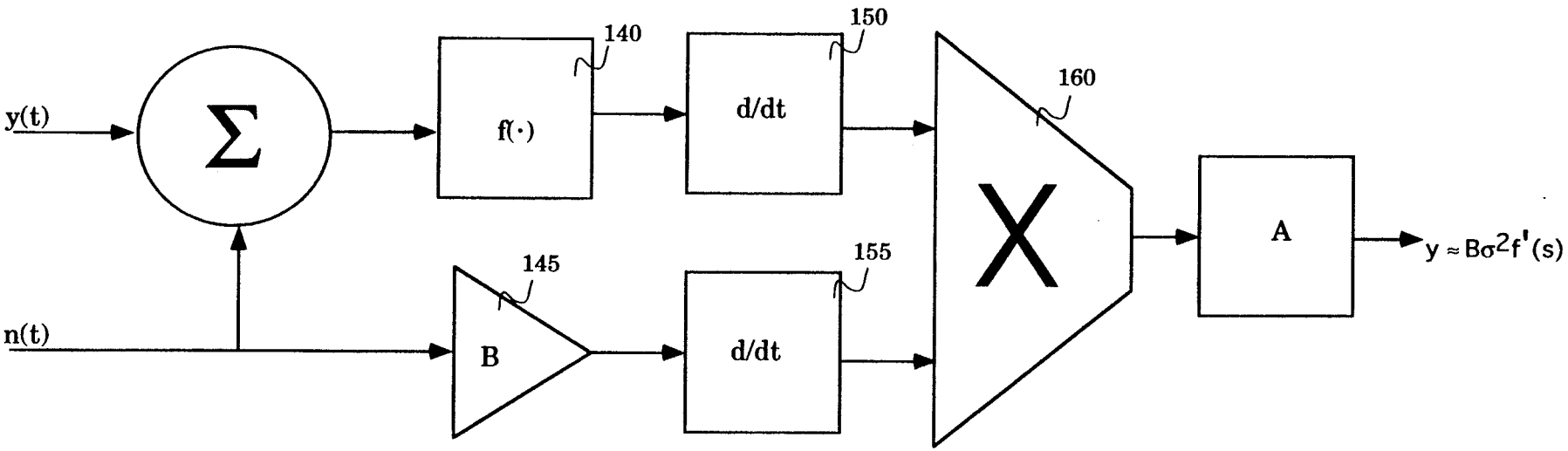
FIG. 4 is a block diagram illustration of an alternate embodiment of a gradient estimation circuit.
Figure 5:
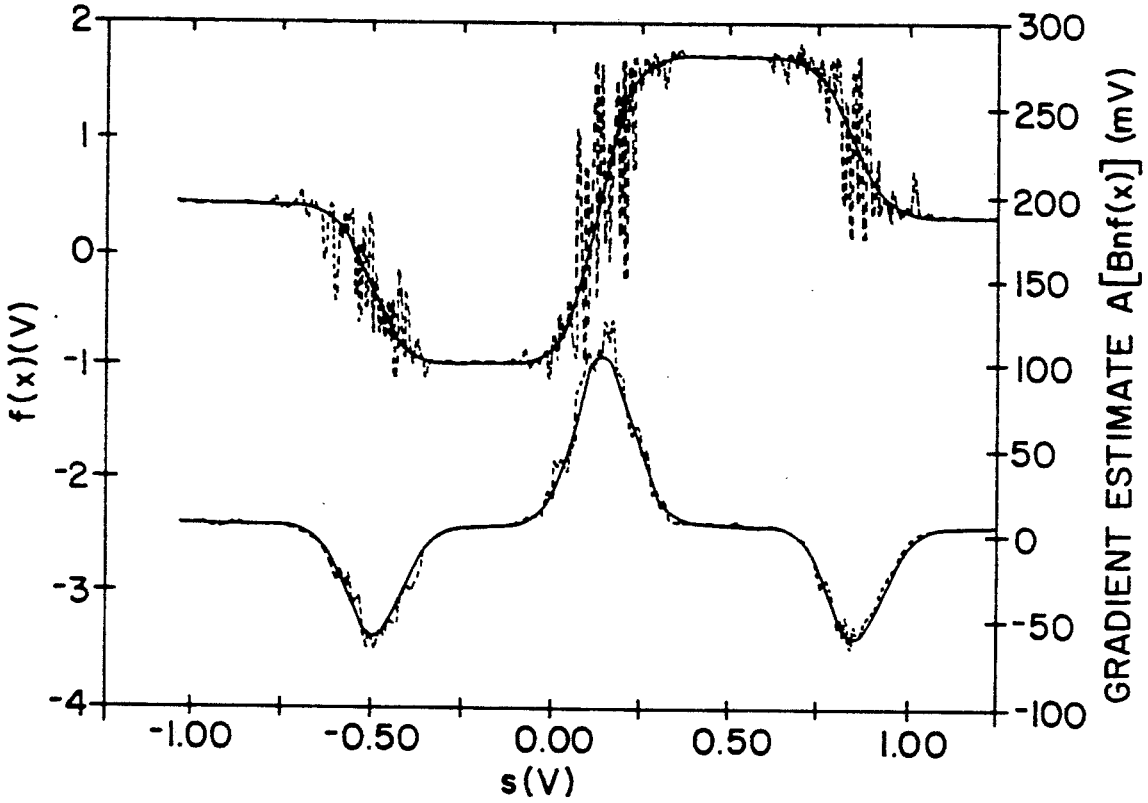
FIG. 5 is a signal plot of the output of the gradient estimation circuit of FIG. 4 using the input signal of FIG. 2b.

An alternate embodiment is shown in FIG. 4. In particular, the circuit represents an implementation of $E[\dot{n}\dot{f}(x)]A[B\dot{n}\dot{f}(x)]$ where B is an optional adjustable gain parameter. In this embodiment, differentiators 150, 155 are coupled between the output of the target function f(x) 140 and the correlator input and the output of the amplifier 145 and the input to the correlator 160.

In this embodiment the function $E[\dot{n}\dot{f}(x)]$ is used in order to find the direction of the gradient. The "dots" represent differentiation in time is used to find the direction of the gradient. Assuming $|n| << 1$, $$\dot{f}(x) = (\dot{n} + \dot{s}) f'(x) = (\dot{n} + \dot{s})[f'(s) + nf''(s) + O(n^2)],$$

and $$\dot{n}\dot{f}(x) = \dot{n}^2 f'(s) + \dot{n}\dot{s} f'(s) + \dot{n}^2 n f''(s) + \dot{n} n \dot{s} f''(s) + O(n^2). \quad (5)$$

Where n is independent of s, since $$E[\dot{n}] = \frac{d}{dt} E[n] = 0,$$

and $$E[\dot{n}n] = \frac{1}{2} \frac{d}{dt} E[n^2] = 0,$$

$$E[\dot{n}\dot{f}(x)] = v^2 f'(s) + O(E[n\dot{n}^2])$$

where $v^2 = E[\dot{n}^2]$ = a constant (because the noise has a stationary probability distribution). Under these conditions, $E[\dot{n}\dot{f}(x)]$ is approximately proportional to the gradient as long as $|n|$ is small.

Again, using a low-pass filter A to approximate E, $y \triangleq A[\dot{n}\dot{f}(x)]$ and $y_0 \triangleq v^2 f'(s)$.

$$E[y] = E[A[\dot{n}\dot{f}(s)]] = A[E[\dot{n}\dot{f}(x)]] = v^2 f'(s) - + O(E[n\dot{n}^2]) + v^2 \Delta_s$$

where $\Delta_s = A[f'(s)] - f'(s)$. Assuming s is slowly varying so that $|\dot{s}|$ is small and $|\Delta_s| << 1$. From (5), again it is clear the first term contributes the most variance (all other terms are higher order in n except the second, and the second is smaller because $|\dot{s}|$ is small). From (3), $V[A[n^2 f'(s)]] = O(W_a \eta^2 T_{ac} P_s)$ where $W_a$ is the bandwidth of the filter, $T_{ac}$ is the autocovariance time of $\dot{n}$, $P_s$ is a measure of the power in f'(s) and $\eta^2 = E[\dot{n}^2]$. Thus, to lowest order in n, $$V[y] = O(W_a \eta^2 T_{ac} P_s).$$

Altogether, $$SNR = \frac{v^4 [f'(s)]^2}{O(W_a \eta^2 T_{ac} P_s) + [O(E[n\dot{n}^2]) + v^2 \Delta_s]^2}, \quad (6)$$

The numerator is O(1) (v is not small). To get SNR>O(1), the denominator has to be <O(1). Adjust $\Delta_s$ so that it is <O(1) (it is already small, so its role in the SNR should be minimal). Then, since $E[n\dot{n}^2] = O(\sigma)$ the second term in the denominator is <O(1). As $P_s > \max_t[f'(s(t))]^2$, $P_s$ is not in general small, so $W_a T_{ac} < O(1)$. If all of these conditions are satisfied and the noise amplitude is made small enough, $A[\dot{n}\dot{f}(x)] \approx v^2 f'(s)$.

Figure 6:
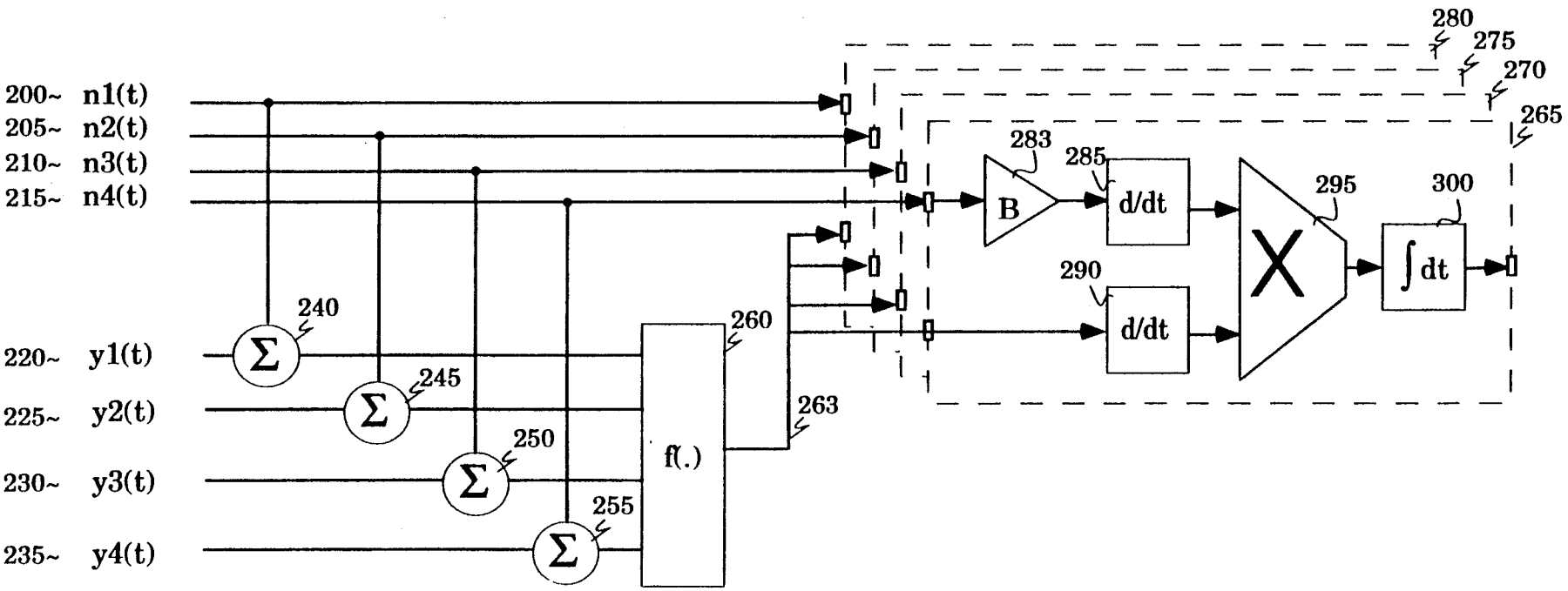
FIG. 6 is a block diagram representation of a four dimensional gradient estimation circuit of the present invention.

The circuit can be expanded into multiple dimensions. A block diagram representation of a four dimensional gradient estimation circuit is shown in FIG. 6. Although the present invention is described in terms of four dimensions it is apparent to one skilled in the art that this circuit can extended to higher dimensions or modified to operate in lower multiple order inventions.

A multidimensional gradient descent operation to be approximated can be written as follows:

$$\underline{y}'(t) = -k \nabla f(\underline{y}(t))$$

where the solution is obtained continuously in time t, rather than at discrete $t_i$, and y and y' are vectors. The circuit described in the block diagram in FIG. 6 computes an approximation to the following:

$$\nabla f = \frac{\partial f}{\partial y_i} \approx \int \left( \frac{d}{dt} f(\underline{y}(t) + \underline{n}(t)) n_i'(t) \right) dt$$

It is assumed that over the operating range the operations of differentiation and integration in time are approximated by realizable high-pass and low pass filters, respectively. To see that this result is useful for approximating the above equation, an N-dimensional extension is provided. Using the chain rule, $$\frac{d}{dt} f(\underline{y}(t) + \underline{n}(t)) = \sum_j (y_j'(t) + n_j'(t)) \frac{\partial f}{\partial y_j}$$

Assuming $n'_j >> y'_j$, the rhs is approximated to produce $$\frac{d}{dt} f(\underline{y}(t) + \underline{n}(t)) = \sum_j n_j'(t) \frac{\partial f}{\partial y_j}$$

Multiplying both sides by $n'_i$, and taking the expectation integral operator E[] of each side, $$E\left[ n_i' \frac{d}{dt} f(\underline{y}(t) + \underline{n}(t)) \right] = E\left[ n_i' \sum_j n_j'(t) \frac{\partial f}{\partial y_j} \right]$$

Since $n'_i$ independent of $n'_j$ when $i \neq j$, the sum on the right side of the equation has a contribution only when $i=j$, $$E\left[ n_i' \frac{d}{dt} f(\underline{y}(t) + \underline{n}(t)) \right] = E\left[ n_i' n_i'(t) \frac{\partial f}{\partial y_i} \right]$$

$$E\left[ n_i' \frac{d}{dt} f(\underline{y}(t) + \underline{n}(t)) \right] \approx \alpha \frac{\partial f}{\partial y_i} = \alpha \nabla f$$

The expectation operator E[] can be used to smooth random variations of the noise $n_i$. Therefore, $$\nabla f = \frac{\partial f}{\partial y_i} \approx \frac{1}{\alpha} E\left[ n_i'(t) \frac{d}{dt} f(\underline{y}(t) + \underline{n}(t)) \right]$$

Since k is arbitrary, $\alpha$ can be absorbed. Using the above equation the gradient descent can be approximated as follows:

$$y_i'(t) \approx -\hat{k} E\left[ n_i'(t) \frac{d}{dt} f(\underline{y}(t) + \underline{n}(t)) \right]$$

Figure 7:
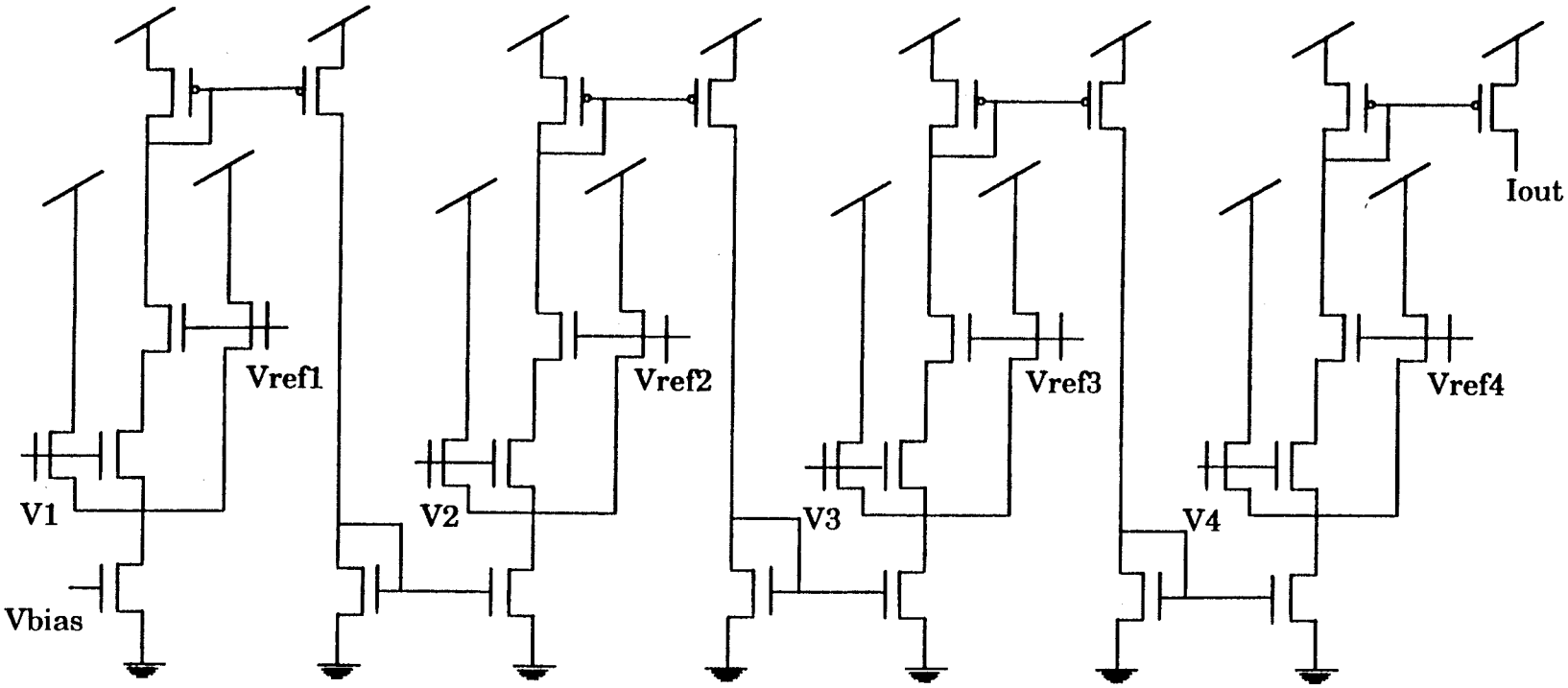
FIG. 7 is a circuit diagram illustration of a four dimensional extension of a bump circuit utilized as an exemplary target function in the multidimensional gradient estimation circuit of the present invention.

Referring back to the block diagram of FIG. 6, a plurality of noise inputs 200, 205, 210, 215 and signal inputs 220, 225, 230, 235 are respectively summed via a summing circuit 240, 245, 250, 255, such that the noise input 200 and the corresponding input signal of the same dimension 220 are summed via the summing circuit for each of the respective dimensions. Preferably the N signal inputs $Y_i$ (t) are additively contaminated with N noise signals $N_i$(t) by capacitive coupling. The output of the summing circuits 240, 245, 250, 255, are the multiple inputs to the N-dimension target function 260. In the general case, the target function can be any scalar function or error metric computed for a particular number of dimensions. Preferably this circuit is a multiple dimensional variant of the bump circuit described in copending U.S. patent application Ser. No. 07/981,763, filed Nov. 25, 1992, titled "An N-Dimensional Basis Function Circuit". FIG. 7 illustrates a four dimensional bump circuit.

Referring back to FIG. 6, the output 263 of the target function 260, I-out, is then input to each individual sub-circuit 265, 270, 275, 280. One sub-circuit is provided for each dimension of the function. Each sub-circuit 265, 270, 275, 280 receives as input the output of the target function 260 and the corresponding noise source signal 200, 205, 210, 215. The noise is first scaled by scale factor B. This is used to set the scale of the noise to match the function output. The scaled noise function and the target function value are differentiated respectively, using differentiators 285 and 290. The differentiator 285, 290 are preferably implemented by approximating the time derivatives of the noise signals and the functions calculated using a high pass filter.

The outputs of the differentiators 285, 290 are input to a correlation circuit shown herein as the multiplier circuit 295 which computes the correlation between the noise value and the function output. Preferably, the circuit 295 compensates for offsets. Offsets vary from transistor to transistor. In an analog VLSI multiplier, offsets can cause a non-linear response and/or a non-zero output when a zero output is desired. A variety of techniques to compensate for offsets are well-known in the art. For example, offsets can be compensated for by using a differential multiplier which computes $(x-x_0)(y-y_0)$ where x and y are the values to be multiplied and $x_0$ and $y_0$ are the parameters that can be varied to cancel the offsets.

Ideally the multiplier circuit has a tanh-like characteristic limiting the output range for extreme inputs. The output of the correlation circuit 295 is then input to a filter 300 to smooth out the output signals. Preferably the filter is implemented as an integrator which is approximated by a low pass filter. However, it is readily apparent that other types of filters can be used to implement the filter 300. The N-dimensional derivative results corresponding to the outputs for each component of the gradient together o provide an estimate of the gradient.

Figure 8A:
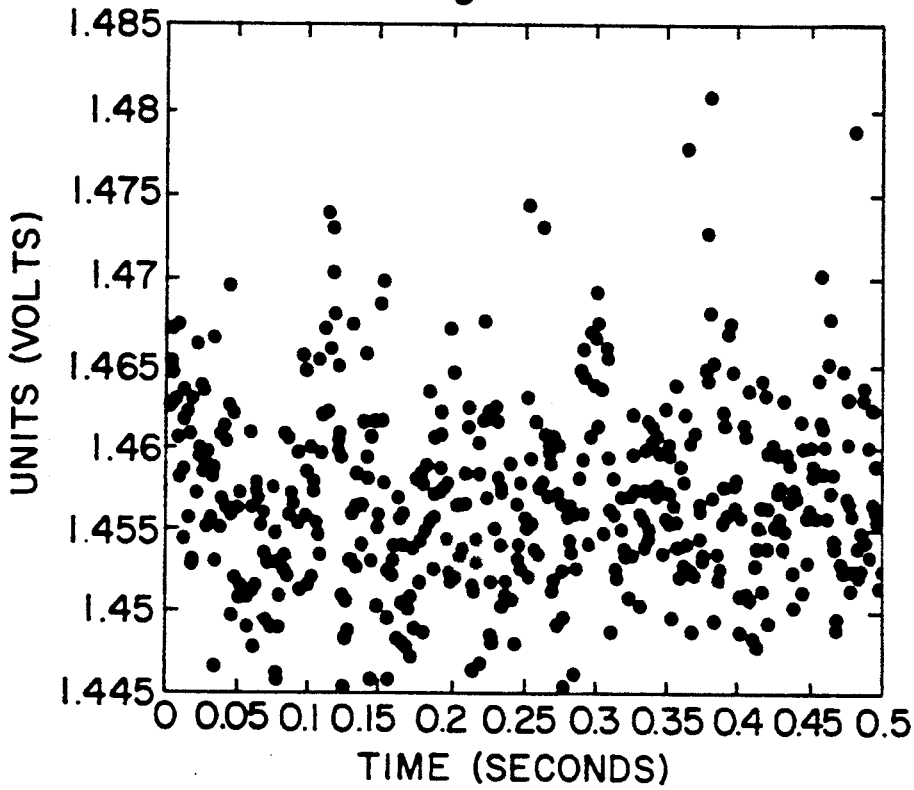
FIGS. 8a and 8b illustrate the measured voltage from a noise circuit as a function of time and the measured power spectrum of the noise.
Figure 8B:
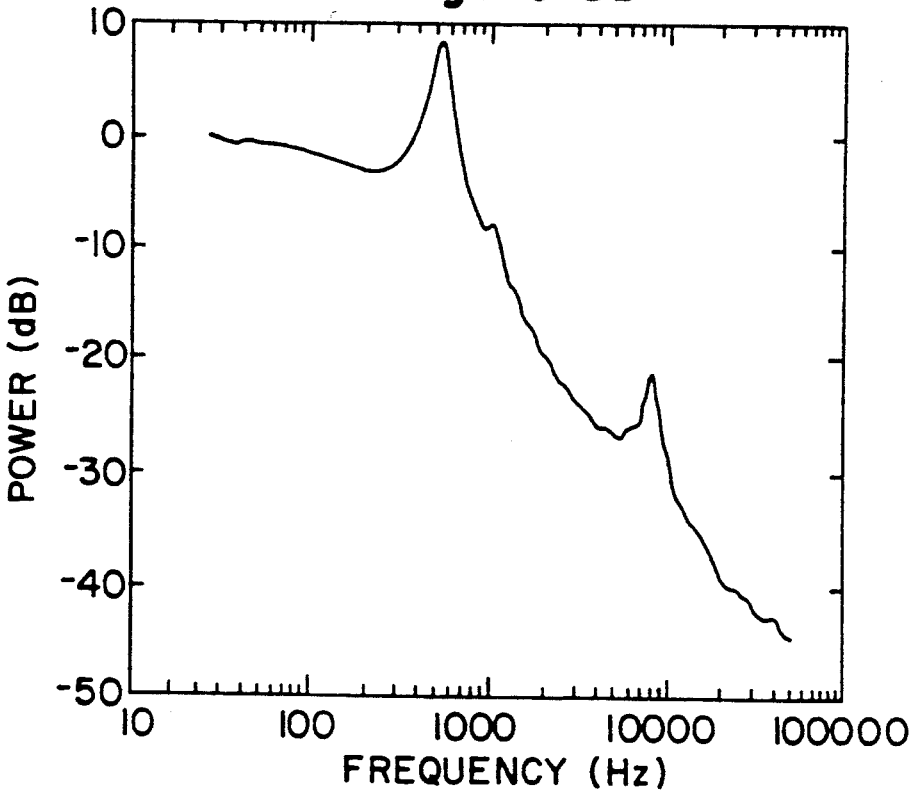

It is preferred that the implementation the circuit in multiple dimensions maintains the uncorrelated nature of the noise functions thereby guarantees the efficient operation of the circuit by individually contaminating the input signals with the noise signals. Simulation performed on the circuit shows encouraging results. FIG. 8*a* shows the measured response of the noise synthesis circuit and the power spectrum of that noise FIG. 8*b*.

Figure 9:
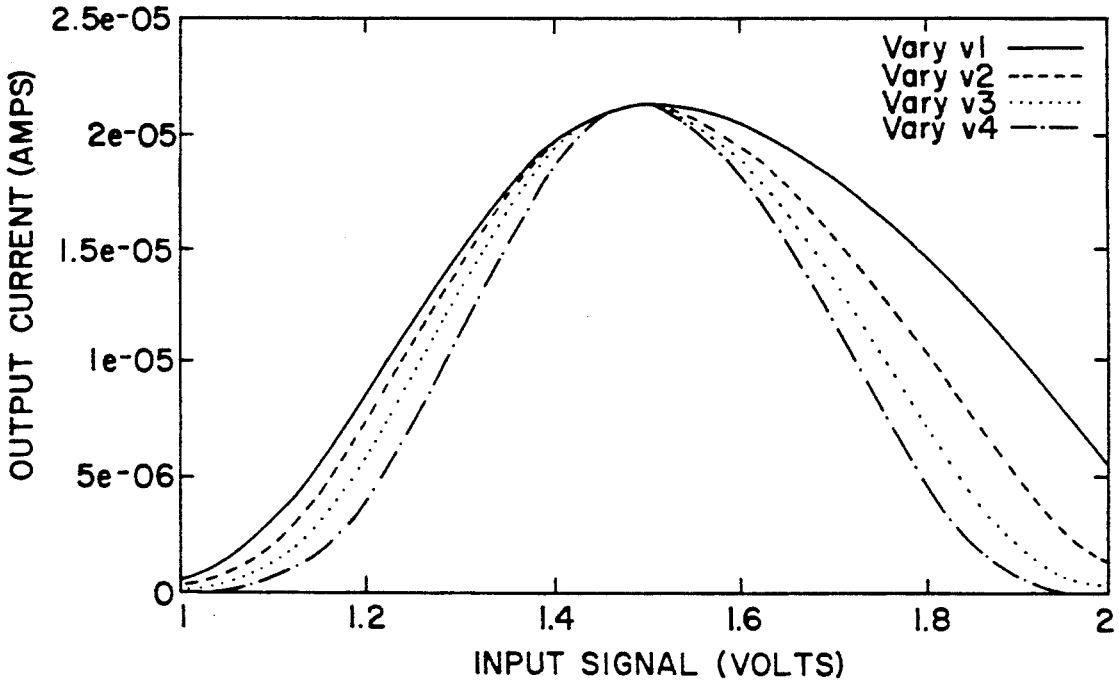
FIG. 9 shows a simulation of a four dimensional implementation of an N-dimensional bump circuit.

FIG. 9 is illustrative of the results of the simulation of the four dimensional implementation of a target function, a four dimension bump circuit. The four curves represent responses where each of the four input parameters is individually varied. The curves VaryV1 through VaryV4 show the effects of varying inputs, V1 through V4 respectively, one at a time. The reference values Vref1 through Vref4 are held at 1.5 volts.

Figure 10A:
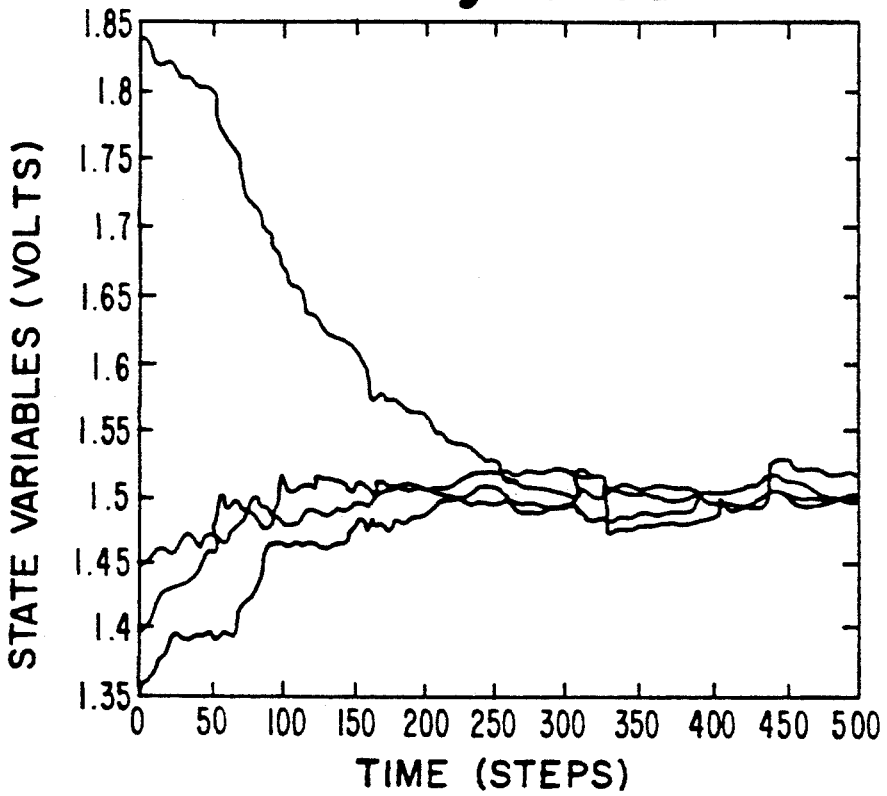
FIG. 10*a* illustrates the gradient descent simulation results for small noise magnitude and short integration time and FIG. 10*b* shows the gradient descent simulation results for large noise magnitude and long integration time utilizing the multidimensional gradient estimation circuit of the present invention.
Figure 10B:
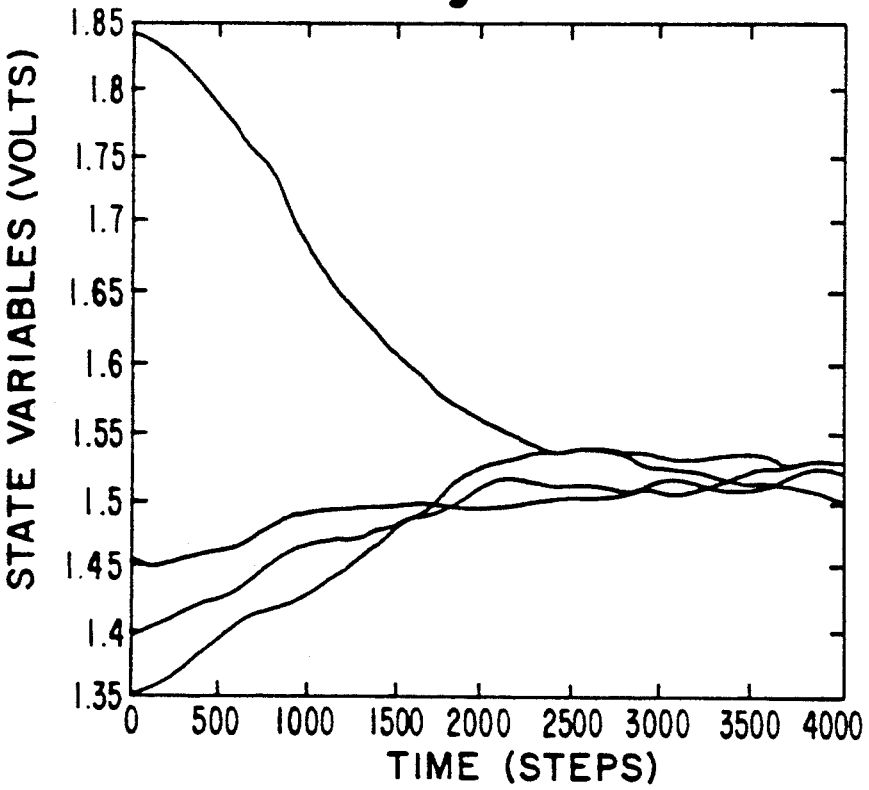

FIG. 10*a* and FIG. 10*b* represent a simulation output for a four dimensional circuit using a four dimension bump circuit as the target function. In simulation, noise data was fed into the four dimension bump circuit, differentiated and correlated. Random initial conditions for the four state variables were chosen and used and the gradient estimates to perform the gradient descent were utilized. FIGS. 10*a* and 10*b* show two parameter choices for the simulation. FIG. 10*a* shows the simulation for small magnitude of noise and very short integration time for the gradient estimate. The trajectories of the four state variables, Y1, Y2, Y3 and Y4 are shown over time as they each approach 1.5 volts, which minimizes the scalar function. FIG. 10*b* shows the longer integration time with larger scale noise input (noise is magnified 5×).

Therefore, an analog circuit for estimating gradients for the purpose of performing gradient descent of a target function in one or more dimensions has been described. The invention has been described in conjunction with the preferred embodiment. It is evident that numerous alternatives, modifications, variations and uses, will be apparent to those skilled in the art in light of the foregoing description.

In particular, the circuit and method described can be utilized to generate a gradient-like signal where each component of the gradient is individually scaled by a different value. This gradient-like signal can be utilized in other known descent algorithms, and can be used to descend to a function minimum. For example, in a circuit in which the components are inaccurate in operation, the output components will naturally be scaled differently to gain the desired effect. Alternately, a scale function, such as an amplifier can be placed at each component output in order to scale the outputs to different values.

Furthermore, in another embodiment, the scale of the noise is varied over time to permit an annealing style of optimization. This embodiment helps to prevent stopping at local minima while descending to the minimum of the function. In particular, for example, the noise amplitude is varied as the circuit descends to a minimum such that initially the noise amplitude is scaled to a large amplitude and is linearly decreased as the minimum is reached. As the initial noise amplitude is large, the output of the circuit will vary by greater amounts reducing the likelihood that the output will stop at local minima. As the circuit output reaches the minimum, the noise is scaled by smaller amounts such that the global minimum is rapidly reached with greater probability.

What is claimed is:

1. A circuit for implementing a N-dimensional gradient estimate for a function f(), comprising:

input means for receiving N input signals $y_i(t)$ and noise signals $n_i(t)$, where i represents a component of an N-dimensional signal, and coupling means for combining an input signal and a noise signal of the same component to produce a combined signal for each component;

means for determining an output signal of f() based on the combined signals input;

N sub-circuits for determining a derivative estimate for the input signal of each component, each sub-circuit receiving as input the output signal of the function f() and the corresponding noise signal for the sub-circuit component, each sub-circuit comprising;

a correlator for determining a correlation between the noise signal and the output signal of f(), and an integration function integrating the correlated signal to produce a derivative estimate for the corresponding component;

wherein N derivative estimates for the N input signals are generated, forming the gradient.

2. The circuit as set forth in claim 1, wherein each sub-circuit further comprises a scale factor, coupled between the means for determining the output signal of f() and the correlator to receive the output of the function f() and output a scaled signal.

3. The circuit as set forth in claim 1, wherein each sub-circuit further comprises a scale factor, coupled to receive the noise signal for the sub-circuit dimension and output a scaled noise signal to the correlator.

4. The circuit as set forth in claim 1, wherein each sub-circuit further comprises a first differentiator coupled to receive the noise signal input and generating a derivative of the noise signal for input to the correlator, and a second differentiator coupled between the means for determining the output signal of f() and the correlator for generating the derivative of the output signal.

5. The circuit as set forth in claim 4, wherein the first and second differentiators each comprises a high pass filter.

6. The circuit as set forth in claim 5, wherein the integration function is generated by an integrator which is approximated by a low pass filter.

7. The circuit as set forth in claim 1, wherein the gradient estimate is continuously fed back as input to the circuit to minimize the function f().

8. The circuit as set forth in claim 1 wherein each of the noise signals $n_i(t)$ is independent and uncorrelated to the noise signals corresponding to other dimensions.

9. The circuit as set forth in claim 1, wherein the coupling means comprises capacitive coupling.

10. The circuit as set forth in claim 1, wherein the function f() is generated by a circuit which computes a scalar function.

11. The circuit as set forth in claim 1, wherein the function f() is generated by a circuit which computes an N-dimensional scalar function.

12. The circuit as set forth in claim 1, wherein the function f() is generated by a circuit which computes an error metric.

13. The circuit as set forth in claim 1, wherein the function f() is generated by an N-dimensional circuit which computes a similarity measure.

14. The circuit as set forth in claim 13, wherein the function f() is generated by an N-dimensional bump circuit.

15. The circuit as set forth in claim 1, wherein the correlator comprises a multiplier.

16. The circuit as set forth in claim 1, wherein each sub-circuit further comprises a scale means to scale the N derivative estimates by a different value to produce a signal which can be used in a descent algorithm to determine a minimum of the function.

17. The circuit as set forth in claim 16, wherein each N derivative estimate is scaled by inaccuracies of the components of the sub-circuit.

18. The circuit as set forth in claim 16, wherein each of the derivative estimates is scaled by an amplifier.

19. The circuit as set forth in claim 1, further comprising means for scaling the noise signal over time to provide an annealing style of optimization wherein local minima are avoided while descending to the global minimum of the function.

20. A circuit for implementing a N-dimensional gradient for a function f(), wherein N is greater than one, comprising:

input means for receiving a plurality of input signals $y_i(t)$ and noise signals $n_i(t)$, where i represents the component of a signal and each of the noise signals $n_i(t)$ is independent and uncorrelated to the noise signals corresponding to other components;

coupling means for combining an input signal and a noise signal of the same component to produce a combined signal for each component;

means for determining an output signal of f() based on the combined signals input;

N sub-circuits for determining a gradient estimate for the input signal of each component, each sub-circuit receiving as input the output of the function f() and the corresponding noise signal for the sub-circuit component, each sub-circuit comprising;

a scale factor, coupled to receive the output of the function f() and outputting a scaled signal, a first differentiator for generating a derivative of the noise signal, a second differentiator for generating a derivative of the scaled signal, a multiplier for determining a correlation between the differentiated noise signal and the differentiated scaled signal, and a low pass filter for filtering the correlated signal to produce a gradient derivative for the corresponding dimension, wherein N derivative estimates for the N input signals are generated.

21. A method for implementing a N-dimensional gradient function for a function f(), said method comprising the steps of:

inputting at least one input signal $y_i(t)$ and noise signal $n_i(t)$, where i represents a component of the signal;

combining the input signal and a noise signal of the same component to produce a combined signal for each component;

determining an output of the function f() based upon the combined signals input;

generating a gradient estimate for the input signal of each component, based upon the output of f() and the corresponding noise signal of the component, comprising the steps of;

correlating the output of the function and the noise signal, and filtering the correlated output to produce a gradient component for the dimension;

such that N derivative estimates for the N input dimensions are generated.

22. The method for implementing a N-dimensional gradient function for a function f(), as set forth in claim 21, further comprising the step of scaling the output of f() by a scale factor to produce a scaled output.

23. The method for implementing a N-dimensional gradient function for a function f(), as set forth in claim 21, further comprising the step of scaling the noise signal prior to the step of correlating the output of the function and the noise signal.

24. The method for implementing a N-dimensional gradient function for a function f(), as set forth in claim 21, further comprising the steps of:

differentiating the output; and differentiating the corresponding noise signal for the component.

25. The method for implementing a N-dimensional gradient function for a function f(), as set forth in claim 21 wherein each of the noise signals $n_i(t)$ is independent and uncorrelated to the noise signals corresponding to other components.

26. The method as set forth in claim 21, further comprising the step of scaling each of the N derivative estimates by a different value to produce a signal which can be used in descent algorithms to determine a minimum of the function.

27. The method as set forth in claim 21, further comprising the step of scaling the noise signal by varying amounts over time to provide an annealing style of optimization wherein local minima are avoided while descending to the global minimum of the function.

28. A method for implementing a N-dimensional gradient function for a function f(), wherein N is greater than one, said method comprising the steps of:

inputting a plurality of input signals $y_i(t)$ and noise signals $n_i(t)$, where i represents a component of the signal and each of the noise signals $n_i(t)$ is independent and uncorrelated to the noise signals corresponding to other components;

combining the input signal and a noise signal of the same component to produce a combined signal for each component;

determining an output of the function f();

generating a gradient estimate for the input signal of each component, based upon the output of f() and the corresponding noise signal of the component, comprising the steps of;

scaling the output of f() by a scale factor to produce a scaled output, differentiating the scaled output, differentiating the corresponding noise signal for the component, correlating the differentiated scaled output and the differentiated noise signal, low pass filtering the correlated output to produce a derivative estimate for the component;

such that N derivative estimates for the N input dimensions are generated.

29. In a very large scale integration (VLSI) circuit, a circuit for implementing an N-dimensional gradient descent for minimizing an on-chip function f(), said circuit receiving N component noise signals $n_i(t)$ and N component input signals $y_i(t)$ and using the noise signals for estimating a gradient of an error measure, said circuit comprising:

capacitive coupling means for combining an input signal and a noise signal of the same component to produce a combined signal for each component;

means for determining an output of f() based on the combined signals input;

N sub-circuits for determining a gradient estimate for the input signal of each component, each sub-circuit receiving as input the output of the function f() and the corresponding noise signal for the sub-circuit component, each sub-circuit comprising;

a scale factor, coupled to receive the output of the function f() and outputting a scaled signal, a first differentiator for generating a derivative of the noise signal, a second differentiator for generating a derivative of the scaled signal, a multiplier for computing a correlation between the differentiated noise signal and the differentiated scaled signal, and an integrator for filtering the correlated signal to produce a derivative estimate for the corresponding component; wherein N derivative estimates for the N input signals are generated.

* * * * *

UNITED STATES PATENT AND TRADEMARK OFFICE

CERTIFICATE OF CORRECTION

PATENT NO. : 5,329,478

DATED : July 12, 1994

INVENTOR(S) : Kirk et al.

It is certified that error appears in the above-identified patent and that said Letters Patent is hereby corrected as shown below:

On the title page, column 2 before item [57] insert -- Atty.,firm or agent--

--[73] Assignee: California Institute of Technology, Pasadena, California--

Signed and Sealed this

Twenty-sixth Day of December, 1995

*Attest:*

Bruce Lehman

BRUCE LEHMAN

*Attesting Officer*

*Commissioner of Patents and Trademarks*